US007575484B2

(12) United States Patent
Van Der Mee et al.

(10) Patent No.: US 7,575,484 B2
(45) Date of Patent: Aug. 18, 2009

(54) MULTI-CONTACT CONNECTOR

(75) Inventors: Marnix Van Der Mee, Montlouis-sur-Loire (FR); Bernard Van Den Meersschaut, Nazelles-Negron (FR); Stephane Moyon, Neuille le Lierre (FR)

(73) Assignee: Radiall, Rosny Sous Bois (FR)

( * ) Notice: Subject to any disclaimer, the term of this patent is extended or adjusted under 35 U.S.C. 154(b) by 408 days.

(21) Appl. No.: 11/391,303

(22) Filed: Mar. 29, 2006

(65) Prior Publication Data

US 2006/0223372 A1 Oct. 5, 2006

(30) Foreign Application Priority Data

Mar. 31, 2005 (FR) ..... 05 50844

(51) Int. Cl.
*H01R 9/26* (2006.01)

(52) U.S. Cl. ..... 439/716

(58) Field of Classification Search ..... 439/716, 439/94, 532

See application file for complete search history.

(56) References Cited

U.S. PATENT DOCUMENTS 3,236,975 A * 2/1966 De Smidt et al. ..... 337/201
3,293,593 A * 12/1966 Nielsen et al. ..... 439/716
3,757,281 A * 9/1973 Woertz et al. ..... 439/724
4,236,780 A * 12/1980 Stenz et al. ..... 439/716
4,270,835 A * 6/1981 Kordt et al. ..... 439/94
4,454,382 A * 6/1984 Borne et al. ..... 174/158 R
4,907,989 A * 3/1990 Huska ..... 439/812
5,030,139 A * 7/1991 Huska ..... 439/513
5,037,310 A * 8/1991 Marinello ..... 439/61
5,145,418 A * 9/1992 Moranski et al. ..... 439/716
5,694,288 A * 12/1997 Shortt et al. ..... 361/673
5,797,756 A * 8/1998 Nad ..... 439/94
5,803,772 A * 9/1998 Muller et al. ..... 439/716
6,062,914 A * 5/2000 Fasano ..... 439/716
6,129,595 A * 10/2000 Scanlon et al. ..... 439/716
6,146,213 A * 11/2000 Yoon ..... 439/716
6,172,875 B1 * 1/2001 Suzuki et al. ..... 361/729
6,371,435 B1 * 4/2002 Landis et al. ..... 248/694
6,425,770 B1 * 7/2002 Lostoski et al. ..... 439/76.1

(Continued)

FOREIGN PATENT DOCUMENTS

DE 19 39 706 U 6/1966

(Continued)

*Primary Examiner*—T C Patel
*Assistant Examiner*—Vladimir Imas
(74) *Attorney, Agent, or Firm*—Oliff & Berridge, PLC

(57) ABSTRACT

A multi-contact connector case may be configured on a support. The case may include a case body including at least one fastener portion configured to co-operate with the support when the case is mounted on the support; at least one bolt element movable relative to the case body between an unlocked position and a locked position in which the bolt element presses against the support when the case is mounted on the support, the bolt element moving closer to the fastener portion of the case body on passing from the unlocked position toward the locked position; and at least one resilient return member configured to move the bolt element from the unlocked position toward the locked position, the bolt element including at least one elastically deformable tab configured to press against a first abutment of the case body when the bolt element is in the unlocked position.

27 Claims, 5 Drawing Sheets

U.S. PATENT DOCUMENTS

| | | | | |
|---|---|---|---|---|
| 6,475,036 | B2 * | 11/2002 | Morikawa | 439/716 |
| 6,488,527 | B2 * | 12/2002 | Yoon | 439/441 |
| 6,680,842 | B1 * | 1/2004 | Pelaez et al. | 361/631 |
| 6,790,058 | B2 * | 9/2004 | Schlieber | 439/110 |
| 6,802,737 | B2 * | 10/2004 | Bergner et al. | 439/532 |
| 7,011,551 | B2 * | 3/2006 | Johansen et al. | 439/709 |
| 7,156,694 | B1 * | 1/2007 | Anderson | 439/535 |
| 7,286,340 | B2 * | 10/2007 | Karim et al. | 361/647 |
| 7,351,116 | B2 * | 4/2008 | Dold | 439/716 |
| 7,371,979 | B2 * | 5/2008 | Fuzetti et al. | 200/17 R |
| 7,374,453 | B1 * | 5/2008 | Allcock et al. | 439/532 |
| 7,413,487 | B1 * | 8/2008 | Chen | 439/811 |
| 2001/0034165 | A1 * | 10/2001 | Landis et al. | 439/716 |

FOREIGN PATENT DOCUMENTS

| | | | |
|---|---|---|---|
| DE | 92 13 118 | U1 | 2/1993 |
| WO | WO 2004/114466 | A | 12/2004 |

* cited by examiner

MULTI-CONTACT CONNECTOR

This non provisional application claims the benefit of French Application No. 05 50844 filed on Mar. 31, 2005.

SUMMARY

The present invention relates to a multi-contact connector case and to such a multi-contact connector, for use in particular in the field of on-board equipment for aircraft.

The invention seeks in particular to simplify the operations of mounting a multi-contact connector on a support.

The invention thus provides a multi-contact connector case configured for mounting, preferably removably, on a support, the case comprising:

a case body having at least one fastener portion suitable for co-operating with the support when the case is mounted on the support;

at least one bolt element movable relative to the case body between an unlocked position and a locked position in which the bolt element presses against the support when the case is mounted on the support, the bolt element moving closer to said fastener portion of the case body on passing from the unlocked position towards the locked position; and at least one resilient return member configured to move the bolt element from the unlocked position towards the locked position.

By means of the invention, the connector case can be locked on the support manually and without using a tool, while nevertheless ensuring that the connector case is fastened in satisfactory manner to the support.

The connector case can thus be mounted on the support in relatively simple manner.

In an embodiment of the invention, the bolt element is mounted slidably on the case body.

Advantageously, the case body and the bolt element form a housing receiving the resilient return member.

In an embodiment of the invention, the bolt element includes at least one elastically deformable tab suitable for pressing against a first abutment of the case body when the bolt element is in the unlocked position.

Preferably, the case body includes a second abutment against which the elastically deformable tab can bear in order to limit the stroke of the bolt element when the bolt element is moved over a stroke beyond the locking position.

Thus, the bolt element remains secured to the case body and the risk of losing one or more component parts of the connector case is reduced or even eliminated.

Advantageously, the bolt element includes a button connected to the elastically deformable tab, the button defining a bearing surface enabling a user to exert a force on the elastically deformable tab, in particular by means of a finger, in order to unlock the bolt element.

Advantageously, the case body includes a slot through which the button extends.

In an embodiment of the invention, the bolt element includes a groove perpendicular to the sliding direction of the bolt element and configured to co-operate with the support when the bolt element is in the locked position.

Advantageously, the case body and the bolt element include respective first and second identification surfaces, that are preferably plane, and configured in such a manner that when the bolt element is in the unlocked position, the first and second identification surfaces are in a first relative position, in which said surfaces are offset, for example, and when the bolt element is in the locked position, the first and second identification surfaces are in a second relative position, in which the surfaces are substantially in alignment, for example. These first and second identification surfaces may be of different colors, if so desired.

The invention thus makes it possible to verify visually whether the bolt element has been locked correctly.

Preferably, the bolt element includes an actuation portion, e.g. provided with a slot, and configured to provide a user with a hold making it possible, in particular with the help of a tool, to move the bolt element towards its unlocked position against the force exerted by the resilient return member.

Where appropriate, the invention thus makes it possible to re-cock the bolt element, e.g. using a screwdriver, to be ready for subsequent use.

Preferably, the bolt element is made as a single piece, in particular of plastics material.

In an embodiment of the invention, the resilient return member comprises a spring, in particular a helical spring.

In a variant, the resilient return member may comprise some other element, e.g. a block of elastomer.

In an embodiment, the fastener portion of the case body includes at least one tab, in particular a deformable tab, configured to press against the support when the case is mounted on the support, in particular to provide mechanical and electrical connection between the connector and the support.

Putting the tab(s) of the fastener portion of the case body on the support performs a self-cleaning function.

Preferably, the case body is electrically conductive.

In an embodiment of the invention, the case body includes at least one housing configured to receive at least one insulating block for mounting electrical contact elements.

The invention also provides a multi-contact connector comprising a case as defined above together with electrical contact elements mounted in the connector case.

The invention also provides a support for receiving at least one multi-contact connector case, the support having two substantially rectilinear and parallel edges, the support including at least one indexing notch in at least one of the two edges.

The connector case and the support may be configured in such a manner that the case can be mounted on the support only in register with a notch.

The support may include two substantially coplanar margin portions, the fastener portion of the case body engaging on one of said margin portions, and the bolt element engaging on the other margin portion.

The invention also provides an assembly comprising a support and a multi-contact connector case as defined above, the connector case being removably mounted on the support.

The invention also provides a method of mounting an above-defined connector case on a support, the method comprising the following steps:

placing the connector case on the support, the bolt element being in the unlocked position; and then actuating the bolt element, preferably manually, so as to bring it into the locked position on the support.

The invention also provides a method of removing an above-defined connector case from a support on which it is mounted, the bolt element initially being in the locked position, and the method comprising the following steps:

moving the bolt element towards the unlocked position, in particular with the help of a tool; and separating the connector case from the support.

Independently, or in combination with the above, the invention also provides a connection assembly comprising:

a first multi-contact connector case including at least two locking zones each having a series of teeth perpendicular to a first axis, the teeth in each series being regularly spaced apart, the two locking zones being separated from each other by a gap having a first height measured along said first axis; and a second multi-contact connector case suitable for being assembled with the first case, preferably in removable manner, the second case comprising a case body and a locking cap movable relative to the case body parallel to said first axis between an unlocked position and a locked position, the locking cap having at least two elastically deformable tabs, each provided with a locking zone having a series of teeth perpendicular to the first axis, the teeth in each series being regularly spaced apart, each locking zone of an elastically deformable tab co-operating with a locking zone of the first case when the two cases are assembled together and the locking cap is in the locked position, the locking zones of the second case being separated from each other by a gap having a second height measured along said first axis, the second height being different from the first height;

the series of teeth in the locking zones of both cases all having the same pitch, and the difference between the first and second heights not being equal to a multiple of the pitch of the series of teeth.

Where appropriate, one of the first and second heights may be zero.

The invention makes it easier to lock the second case on the first and to prevent the second case from unlocking relative to the first when the assembly is subjected to vibration.

In addition, the invention makes it possible to achieve relatively fine increments in locking while maintaining teeth of a size that is sufficiently large firstly to ensure that they can be made and secondly to guarantee that they provide effective braking.

The invention makes it possible to ensure that at least one of the locking zones is properly engaged on the corresponding locking zone because of the offset between the different locking zones.

In an embodiment of the invention, the difference between the first and second heights is equal to a multiple of half the pitch of the series of teeth.

This configuration is advantageous when the locking cap of the second case includes exactly two elastically deformable tabs that are spaced apart along the first axis.

The difference may be equal to a multiple of one-third of the pitch of the series of teeth, when each of the first and second cases has three locking zones spaced apart along the first axis.

The tabs of the locking cap may all be identical, or otherwise.

The locking zones of the first case may present numbers of teeth that are different or the same.

In an embodiment of the invention, the locking zones of at least one of the first and second cases are substantially in alignment on the first axis.

The first case has a case body, and the locking zones of the first case are preferably made on a side face of the case body.

Each of the elastically deformable tabs may extend in a window in the locking cap, for example.

In an embodiment of the invention, the first case has two pairs of locking zones disposed symmetrically about a plane, each pair preferably being made on a side face of the first case, the locking cap of the second case optionally including two pairs of elastically deformable tabs, each tab being suitable for co-operating with an associated locking zone of the first case.

In an embodiment of the invention, the first case includes at least one blocking element in relief, in particular a stud, and the locking cap includes at least one slot in which the blocking element of the first case can slide when the cap passes from the unlocked position towards the locked position so that when the cap is in the locked position, co-operation between the blocking element and the slot holds the two cases together in a direction perpendicular to the first axis.

Each slot of the locking cap may be substantially L-shaped, for example.

The locking cap is preferably slidably mounted on the body of the second case.

In an embodiment of the invention, the body of the second case includes at least one guide groove, and in particular two parallel guide grooves, each of which can slidably receive a rim of the locking cap.

In an embodiment of the invention, the locking cap includes at least one elastically deformable tab, and in particular two elastically deformable tabs, each being suitable for co-operating with a guide notch formed in the body of the second case.

The first and second cases may be of circular type, the series of teeth of the first case possibly extending, for example, around a circumference of the first case over an angular sector, in particular a 360° sector, and the elastically deformable tabs of the second case may present a cross-section in the form of a circular arc, for example.

By way of example, at least one of the case bodies is made of metal, of plastics material with a metal coating, or of plastics material including a conductive filler.

The invention also provides a multi-contact connector case having at least two locking zones, each with a series of teeth perpendicular to a first axis, the teeth of each series being regularly spaced apart, the locking zones being made on a substantially plane face of a case body.

The invention also provides a multi-contact connector case comprising a case body and a locking cap movable relative to the case body parallel to a first axis between an unlocked position and a locked position, the locking cap having at least two elastically deformable tabs, each provided with a locking zone having a series of teeth perpendicular to the first axis, the teeth in each series being regularly spaced apart.

The invention also provides a multi-contact connector including any one of the cases as defined above.

The invention also provides a method of assembling together the first and second cases of the connector of the above-defined assembly, preferably in removable manner, the method comprising the following steps:

positioning the first and second cases relative to each other by engaging the blocking element(s) of the first case in the slot(s) of the locking cap; and causing the locking cap to slide in translation relative to the body of the second case so as to engage the locking zones of the locking cap on the locking zones of the first case and, at the end of the stroke, so as to bring the blocking element(s) into the corresponding slot(s) of the locking cap in order to block the locking cap relative to the first case.

Independently or in combination with the above, the invention also provides a multi-contact connector case comprising a case body provided with a cable-attachment portion configured to enable cables to be attached to said portion, preferably using an attachment piece distinct from the case body, e.g. a conductive or insulating collar, the attachment portion projecting from the rear of the case body and preferably presenting a cross-section that is substantially U-shaped.

The cable-attachment portion can form a cable-outlet zone with grounding by means of an attachment piece such as a conductive collar, when the case includes a conductive shielding cap.

The attachment portion may optionally be made integrally with the remainder of the case body.

The case body may include a longitudinal gutter extending substantially from a housing in the case body that is to receive an insulating block for electrical contact elements, and as far as the attachment portion.

By way of example, the gutter can serve to guide cables connected to the electrical contact elements as far as the outlet zone of the connector case.

When the case includes a connection face, the longitudinal gutter extends substantially perpendicularly to the connection face.

In an embodiment of the invention, the case includes a conductive shielding cap configured to be capable of being assembled to the case body, preferably in removable manner.

When assembled together, the case body and the shielding cap advantageously form a complete shielding surface.

Depending on the desired functions, the case may be used with a shielding cap mounted thereon, or without a shielding cap.

In an embodiment of the invention, the shielding cap includes a rear portion presenting a substantially U-shaped cross-section, said rear portion being configured to co-operate with the attachment portion of the case body so as to form a tubular opening in the case for inserting cables into the case.

In an embodiment of the invention, the shielding cap includes at least one fastening lug projecting out from the tubular opening and configured to enable cables exiting via the opening to be attached thereto.

Preferably, the shielding cap includes at least one elastically deformable tab configured to co-operate with the case body by snap-fastening in order to hold the shielding cap on the case body.

The elastically deformable tab may also serve, if so desired, to provide satisfactory ground and/or shielding continuity between the case body and the shielding cap, in particular without using a clamping fitting.

In an embodiment of the invention, the shielding cap includes a plurality of elastically deformable tabs on two perpendicular edges of the shielding cap.

Preferably, at least one of the elastically deformable tabs presses against the outside of the case body when the shielding cap is assembled to the case body.

By way of example, this elastically deformable tab may extend over a bottom edge of the shielding cap.

By way of example, the shielding cap may be made out of a metal, out of a plastics material with a metal coating, or out of a plastics material incorporating a conductive filler.

The connector case may be of the rectangular type or of the circular type.

The invention also provides a multi-contact connector comprising a case as defined above, together with contact elements mounted in the connector, said contact elements being connected to cables which are secured to the attachment portion of the case body, e.g. using a fitting such as a collar, the case possibly having no shielding cap.

The invention also provides a multi-contact connector comprising a case as defined above, and electrical contact elements mounted in the connector, the case including a shielding cap mounted on the case body, the contact elements being connected to cables secured to a fastening lug of the shielding cap, e.g. by means of a clamping fitting such as a collar.

The invention also provides a multi-contact connector comprising a case as defined above, and electrical contact elements, the contact elements being connected to cables, the cables being inserted in a sheath with a ground braid secured to the cable-attachment portion of the case body and to the rear portion of the shielding cap of the connector case, said ground braid being held for example by means of a clamping fitting such as a conductive collar.

The invention also provides a method of assembling a connector as defined above, the method comprising the following steps:

fixing the cables connected to the contact elements either to the cable-attachment portion of the case body or to the rear portion and/or the fastening lug of the shielding cap, or by using a ground braid in which the cables are inserted, said braid being held to the case by means of a fitting such as a conductive clamping collar.

The method may further include the following steps:

assembling the shielding cap and the case body by bringing the cap obliquely relative to the case body so as to prevent it from moving in all three directions of three-dimensional space.

BRIEF DESCRIPTION OF THE DRAWINGS

The present invention can be better understood on reading the following detailed description of non-limiting embodiments of the invention, and on examining the accompanying drawings, in which.

DETAILED DESCRIPTION OF EMBODIMENTS

Figure 1:
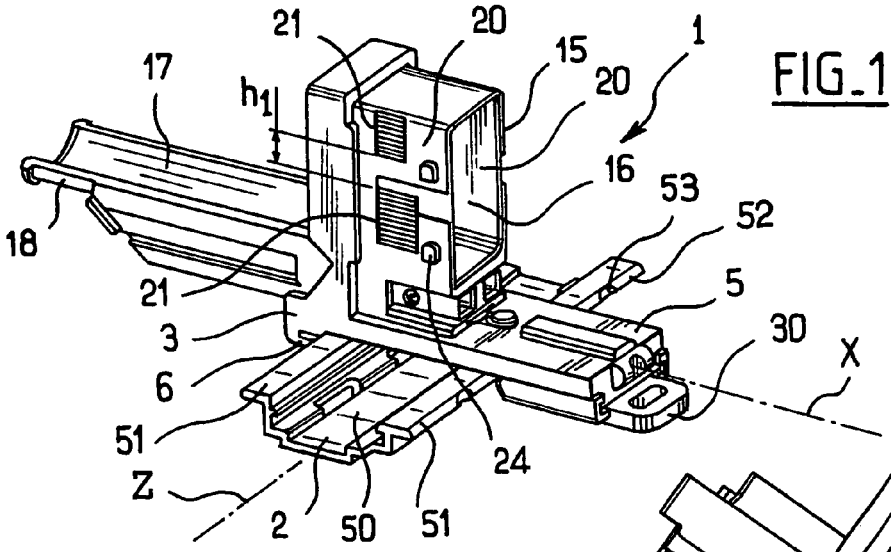
FIG. 1 is a diagrammatic fragmentary view of a multi-contact connector case mounted on a support in accordance with the invention.

FIG. 1 shows a multi-contact connector 1 of rectangular type mounted on a support 2.

The case 1 comprises a case body 3, e.g. made of plastics material and presenting a metal coating.

Figure 2:
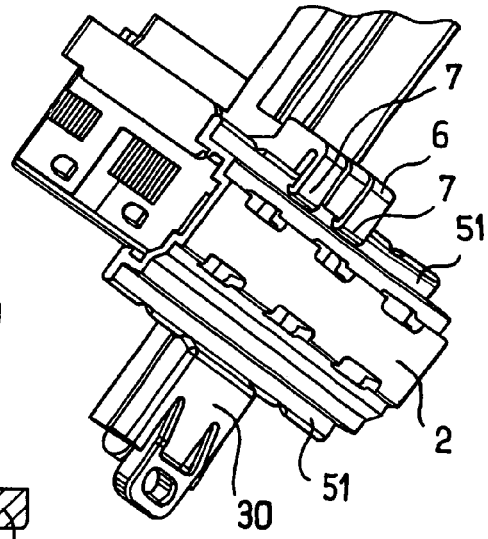
FIG. 2 is a diagrammatic and fragmentary view of the FIG. 1 assembly seen from beneath.

The body 3 includes a base 5 of generally rectangular shape along an axis X having connected thereto a fastener portion 6 having two parallel tabs 7, as can be seen in FIG. 2.

The tabs 7 may be elastically deformable to a small extent in order to enable the tabs 7 to fasten on the support 2 in satisfactory manner, as explained below.

Figure 5:
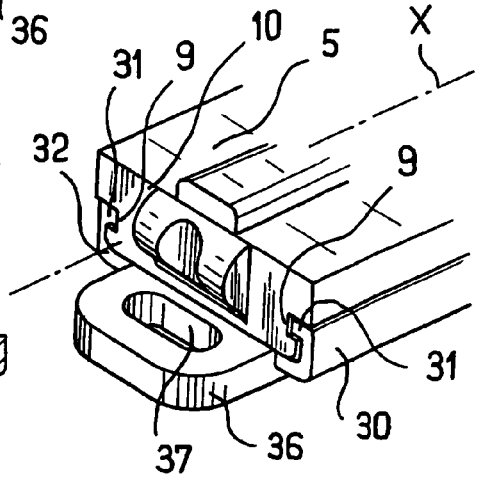
FIG. 5 is a diagrammatic and fragmentary detail view of the FIG. 1 connector case.

The base 5 has two grooves 9 parallel to the axis X, as shown in FIG. 5.

The base 5 also has an identification surface 10 extending perpendicularly to the axis X.

The case 1 also presents a rectangular connection face 15, whereby the case 1 is coupled to a case of a complementary multi-contact connector.

The case 1 also presents a housing 16 for receiving an insulating block for securing electrical contact elements, the housing 16 extending perpendicularly to the axis X and above the base 5, as shown in FIG. 1.

The case 1 has a longitudinal gutter 17 extending along the axis X away from the housing 16 to a cable attachment-portion 18 projecting from the rear of the case 1.

The attachment portion 18 is configured to allow cables to be attached thereto, as described below.

This attachment portion 18 presents a cross-section that is substantially U-shaped.

The housing 16 is defined by two side walls 20 each having two locking zones 21 formed thereon.

Figure 6:
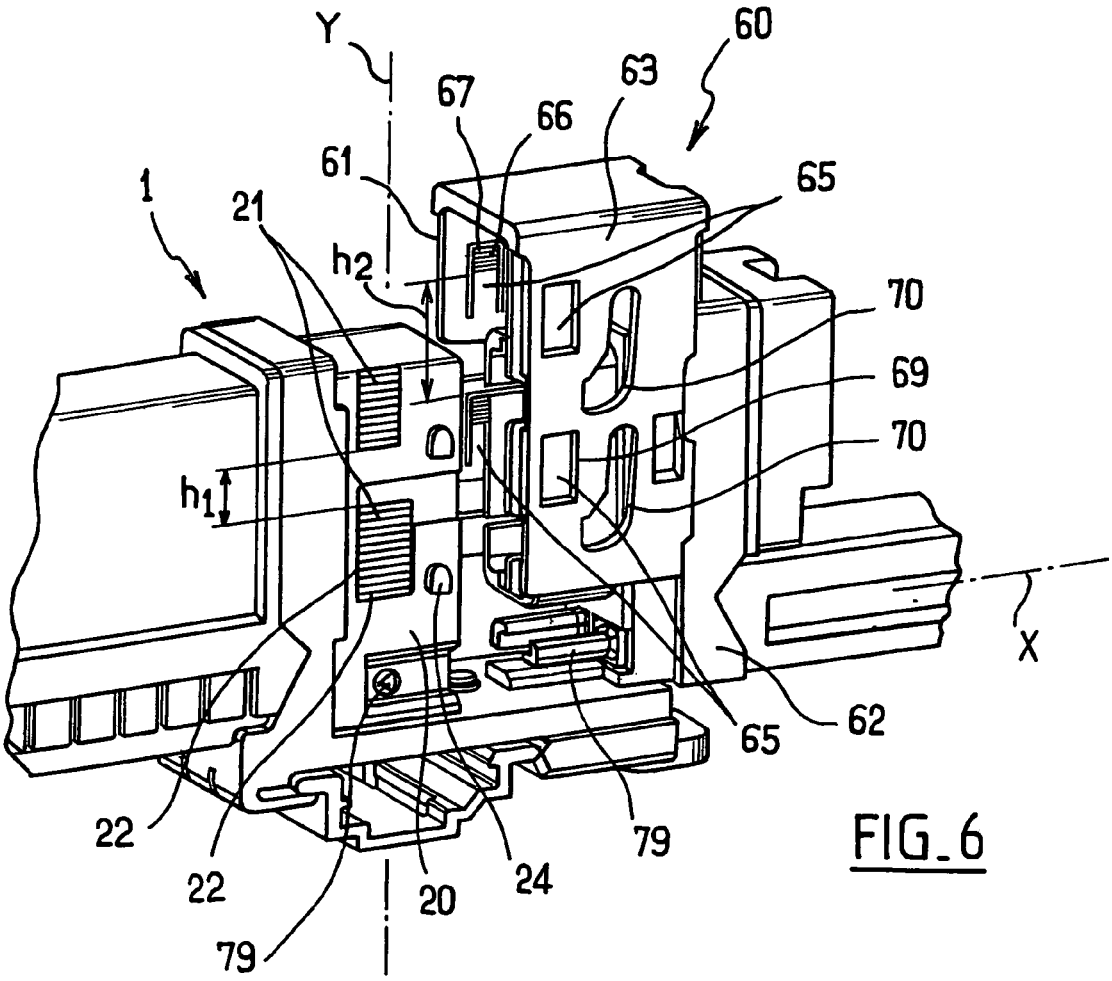
FIG. 6 is a diagrammatic and fragmentary perspective view of two connector cases in accordance with the invention prior to being assembled together.

As shown in FIG. 6, each locking zone 21 comprises a series of teeth 22 extending perpendicularly to an axis Y, the teeth in each series being regularly spaced apart, and the two locking zones 21 being spaced apart from each other by a gap presenting a first height $h_1$ measured along the axis Y.

In the example described, the two locking zones 21 on one side face 20 differ from each other, with the teeth 22 presenting different lengths, for example.

In a variant, the zones 21 could all be identical.

The locking zones 21 of one side face 20 are symmetrical to the locking zones 21 of the other side face 20 about a plane containing the axes X and Y.

The case 1 includes two blocking elements in relief 24 on each side face 20, these elements being constituted, in the example described, by respective studs and performing a function that is described below.

The case 1 also includes a bolt element 30 slidably mounted on the base 5 of the case body 3.

In the example described, the bolt element 30 is made of plastics material, and preferably as a single piece.

The bolt element 30 has two parallel ribs 31 for engaging slidably in the corresponding grooves 9 of the base 5, as shown in FIG. 5.

The bolt element 30 also presents a substantially plane identification surface 32.

Figure 3:
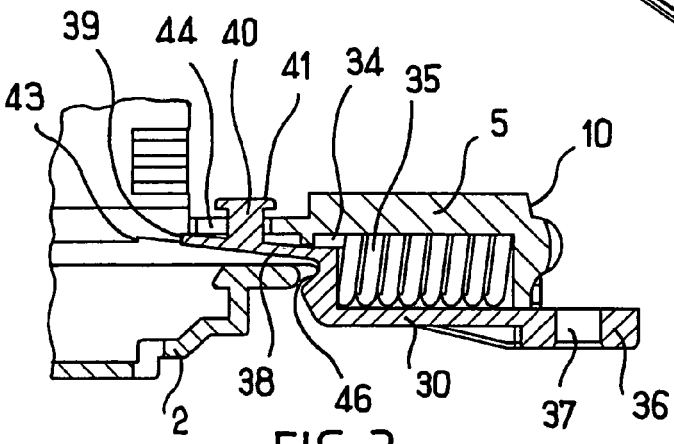
FIGS. 3 and 4 are diagrammatic and fragmentary section views of the FIG. 1 assembly in two different positions.
Figure 4:
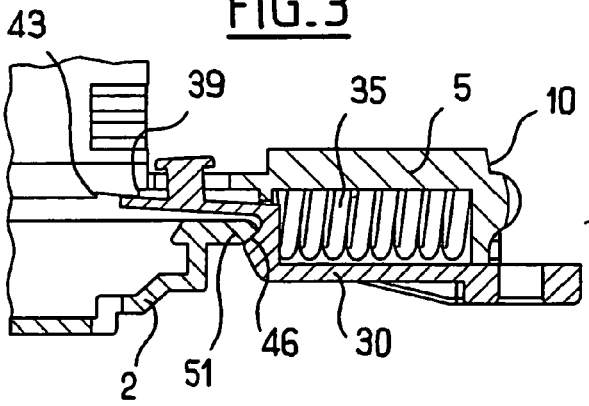

Together with the base 5, the bolt element 30 forms a housing 34 for receiving a resilient return member 35, as shown in FIGS. 3 and 4.

In the example described, the resilient return member 35 is constituted by a helical spring.

The resilient return member 35 has one end bearing against the bolt element 30 and an opposite end bearing against the case body 3.

The bolt element 30 includes an actuation portion 36 provided with a slot 37, said actuation portion 36 providing a user with a hold for engaging a tool such as a screwdriver for the purpose of moving the bolt element 30 against the force exerted by the resilient return member 35.

At its end opposite from the actuation portion 36, the bolt element 30 has an elastically deformable tab 38 configured to press against a first abutment 39 of the case body 3 when the bolt element 30 is in an unlocked position, as shown in FIG. 3.

The first abutment 39 is made on the underside of the base 5 of the case body 3, for example.

The bolt element 30 also includes a button 40 connected to the elastically deformable tab 38, the button 40 defining a bearing surface 41 enabling a user to exert a force, in particular by means of a finger, on the elastically deformable tab for the purpose of disengaging it from the first abutment 39.

The button 40 extends through a slot 44 made in the base 5 of the case body 3.

The case body 3 also presents a second abutment 43 made on the underside of the base 5 and against which the elastically deformable tab 38 can bear in order to limit the stroke of the bolt element 30 when it is disengaged from the first abutment 39 and the connector case 1 is not assembled on the support 2.

This avoids the bolt element 30 becoming separated from the case body 3 when the connector case 1 is not in use, for example while it is being stored prior to being used.

The bolt element 30 presents a groove 46 extending perpendicularly to the axis X and configured to co-operate with the support 2 when the bolt element is in a locked position, as shown in FIG. 4.

The identification surface 10 of the case body 3 and the identification surface 32 of the bolt element 30 lies substantially in continuity with each other when the bolt element 30 is in the locked position, as shown in FIGS. 4 and 5.

In contrast, when the bolt element 30 is in the unlocked position, pressed against the first abutment 39, a stroke has been followed beyond the locking position to press against the second abutment 43, so the identification surfaces 10 and 32 are offset relative to each other along the axis X.

Where necessary, this enables the user to verify visually whether the bolt element 30 is correctly in the locking position.

The support 2 is described in greater detail below.

The support 2 is longitudinal in shape along an axis Z that is perpendicular to the axis X.

In cross-section, i.e. perpendicularly to the axis Z, the support 2 presents a central portion 50 that is substantially U-shaped, and two margin portions 51 on either side of the central portion 50, the margin portions 51 extending in a plane defined by the axes X and Y.

These margin portions 51 define parallel edges 52 that are parallel to the axis Z and that present notches 53 that are regularly spaced apart along each edge 52, these notches 53 acting as indexing elements when mounting the case 1 on the support 2.

In the example described, the support 2 is made of metal.

As can be seen in FIG. 4, when the bolt element 30 is in the locked position, the groove 46 engages on the margin portion 51 of the support 2 by virtue of the force exerted by the resilient return member 35 against the bolt element 30.

The connector case 1 is thus held on the support 2 firstly by the bolt element 30 engaging with a margin portion 51 of the support 2, and secondly by the tabs 7 engaging with the other margin portion 51, as shown in FIG. 2.

These tabs 7 may be elastically deformable to a small extent so as to press with residual stress against the margin portion 51 of the support 2.

It is thus possible to achieve effective mechanical anchoring of the case 1 on the support 2 while also enabling a satisfactory electrical connection to be established between the support 2 and the connector case 1.

If so desired, the connector case 1 may be assembled with a second multi-contact connector case 60, as shown in FIG. 6.

The second case 60 presents a connection face 61 whereby the case 60 is assembled with the case 1.

The second case 60 comprises a case body 62 and a locking cap 63 that is movable relative to the case body 62 parallel to the axis Y between an unlocked position and a locked position.

The locking cap 63 includes two pairs of elastically deformable tabs 65, each provided with a locking zone 66 having a series of teeth 67 perpendicular to the axis Y.

The teeth 67 in each series are regularly spaced apart, each locking zone 66 of an elastically deformable tab 65 being designed to co-operate with a locking zone 21 of the case 1 when the two cases 1 and 60 are assembled together and the locking cap 63 is in the locked position.

The locking zones 66 of the second case 60 are spaced apart from each other along the axis Y by a gap having a second height $h_2$ measured along said axis Y and different from the above-mentioned first height $h_1$.

In the example described, the series of teeth in the locking zones 21 and 66 on the cases 1 and 60 all present the same pitch, and the difference between the first and second heights $h_1$ and $h_2$ is not equal to a multiple of the pitch of the series of teeth.

In the example described, this difference between $h_1$ and $h_2$ is equal to a multiple of half the pitch of the series of teeth.

For example, the height $h_1$ is a multiple of half the pitch of the series of teeth and the height $h_2$ is a multiple of the pitch of the series of teeth.

In a variant, the height $h_1$ is a multiple of the pitch of the series of teeth and the height $h_2$ is a multiple of half the pitch of the series of teeth.

This offset by half the pitch makes it possible to ensure relatively fine incrementation when locking the cap 63 on the body of the case 1.

In the example described, each of the tabs 65 is made in a window 69 of the locking cap 63.

The locking cap 63 presents two pairs of slots 70 in each of which a blocking element 24 of the case 1 can slide when the cap 63 passes from the unlocked position towards the locked position so that once the cap is in the locked position, co-operation between the blocking element 24 and the corresponding slot 70 holds the two cases 1 and 60 together in the direction X.

In the example described, each slot 70 is substantially L-shaped.

The locking cap 63 is mounted to slide on the case body 62.

Figure 8:
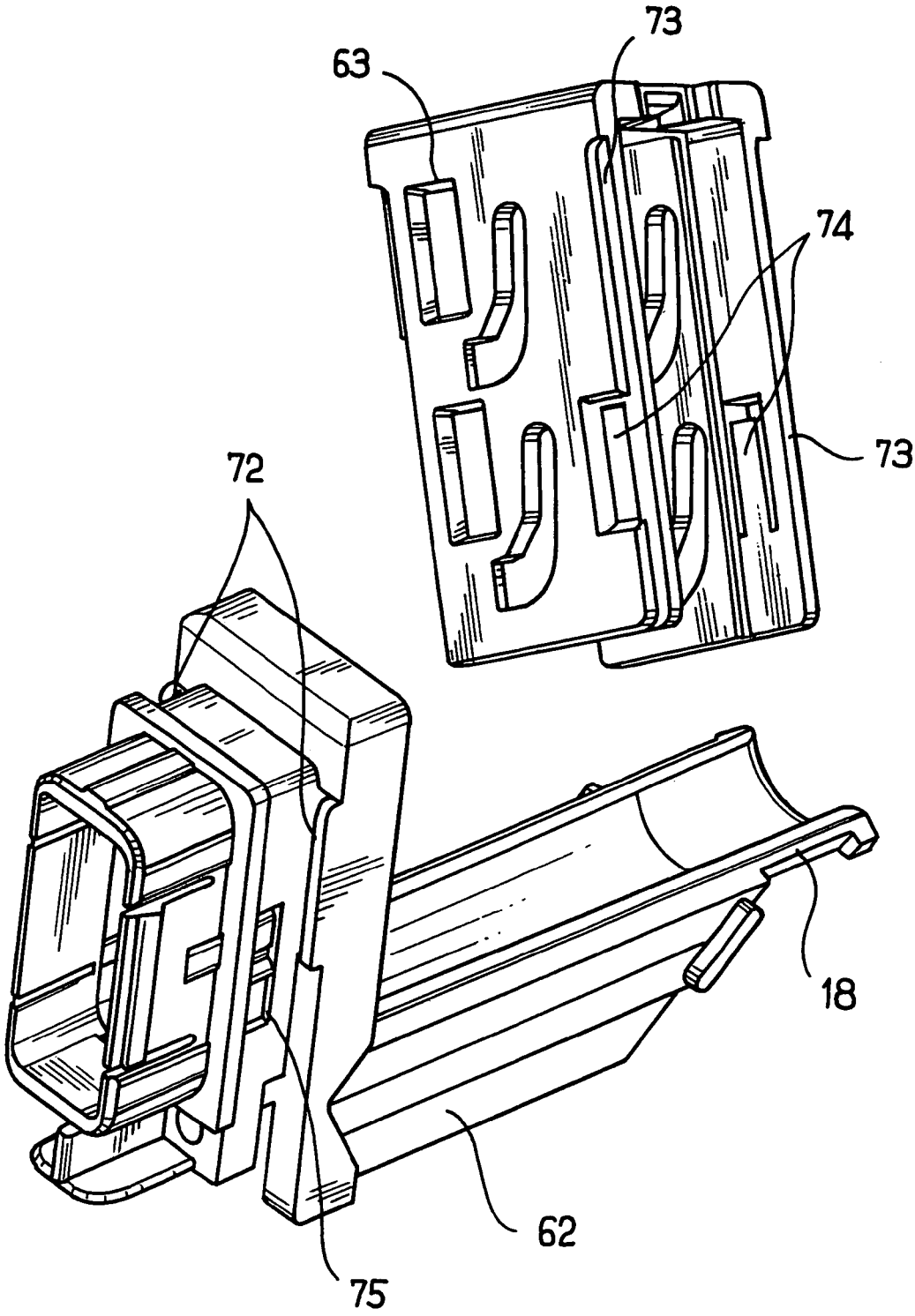
FIG. 8 is a diagrammatic and fragmentary view of the case body and a locking cap in accordance with the invention.

To this end, the case body 62 may include two parallel guide grooves 72 in each of which a rim 73 of the locking cap 63 can slide, as shown in FIG. 8.

The locking cap 63 has two elastically deformable tabs 74, each suitable for co-operating with a guide notch 75 formed in the case body 62.

In the example described, and as shown in FIG. 8, the case body 62 includes a cable attachment portion 18 like the case 1.

The cases 1 and 60 are assembled together in relatively simple manner by bringing these two cases so that they face each other, engaging the elements in relief 24 in the slots 70 and causing the cap 63 to slide along the axis Y so as to prevent the cap 63 from moving relative to the case 62 by means of the co-operation between the locking zones 21 and 66 and the co-operation between the blocking elements 24 and the slots 70.

Figure 7:
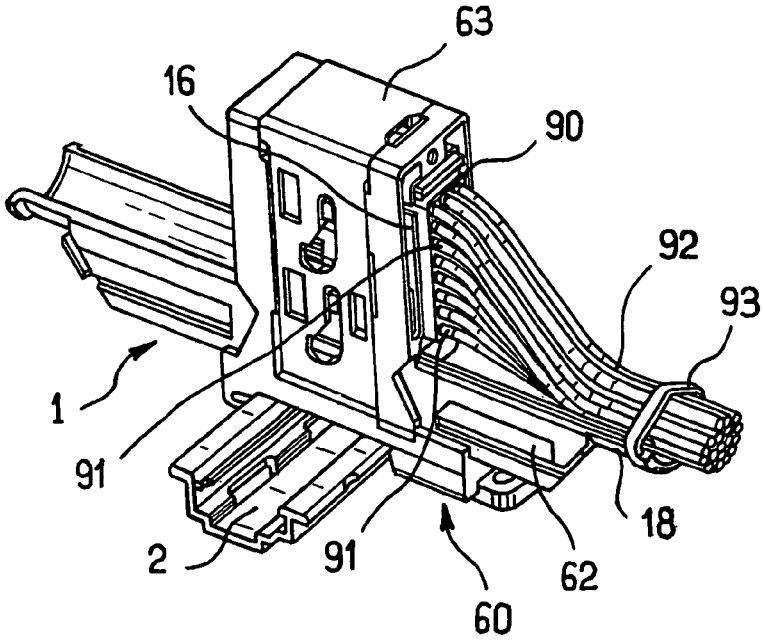
FIG. 7 is a diagrammatic and fragmentary view showing two connector cases in accordance with the invention, once assembled together.

The locked position of the cap 63 is shown in FIG. 7.

As can be seen in FIG. 7, the connector case 60 receives an insulating block 90 secured in the housing 16 and presenting cavities into which electrical contact elements 91 are inserted.

Each contact element 91 is connected to a cable 92.

The bundle of cables 92 is secured to the cable-attachment portion 18 of the case 60 using a clamping collar 93 made of a conductive material, e.g. metal.

This enables the cables 92 to be grounded to the case body 62, with the attachment portion 18 forming an outlet zone for the cables 92.

Figure 9:
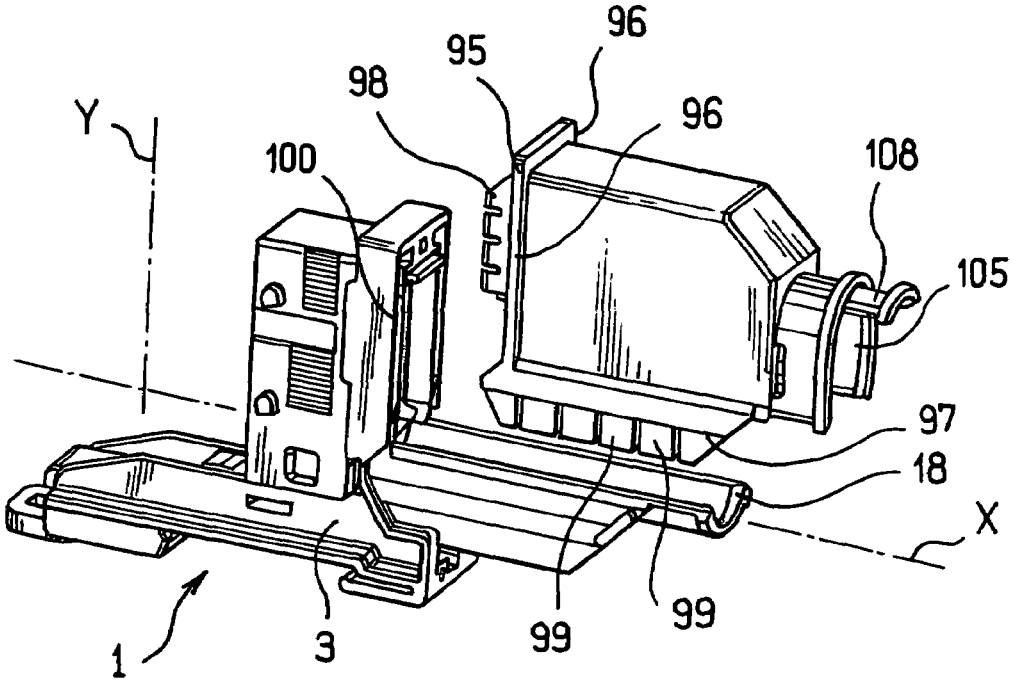
FIGS. 9 and 10 are diagrammatic and fragmentary views of elements of a connector case respectively before and after being assembled together.
Figure 10:
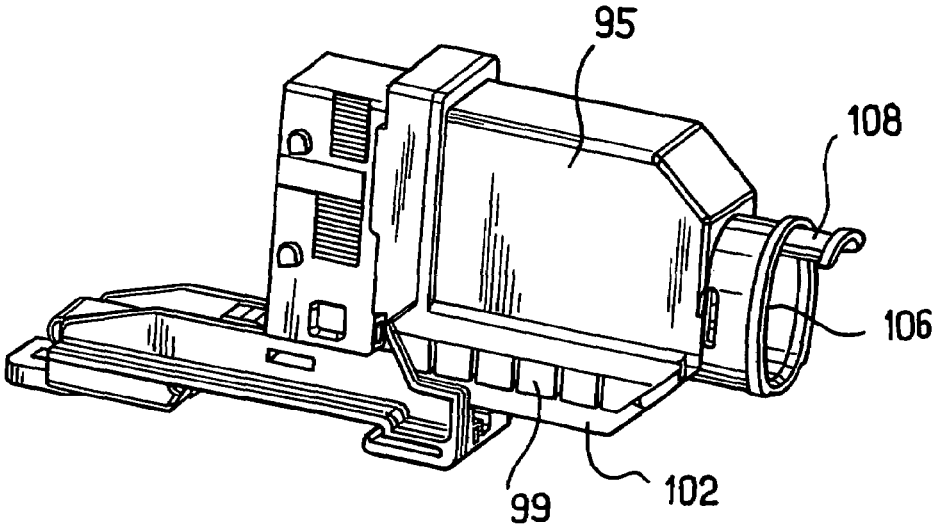

As shown in FIGS. 9 and 10, and if so desired, the connector case 1 may include a shielding cap 95, e.g. made of a metal, of an electrically conductive plastics material, or of a plastics material with a conductive coating.

The shielding cap 95 has two front edges 96 extending parallel to the axis Y and two bottom edges 97 extending parallel to the axis X.

The shielding cap 95 has elastically deformable tabs 98 and 99 on its edges 96 and 97, respectively.

The case body 3 has grooves 100 parallel to the axis Y suitable for receiving by snap-fastening the elastically deformable tabs 98 of the shielding cap 95.

After assembly, as shown in FIG. 10, the elastically deformable tabs 99 press against an outside face 102 of the case body 3.

The contacts of the tabs 98 and 99 against the case body 3 ensures satisfactory ground or shielding continuity between the shielding cap 95 and the case body 3, without requiring any additional clamping means between these two elements.

The shielding cap 95 has a rear portion 105 presenting a substantially U-shaped cross-section, this rear portion 105 being configured to co-operate with the attachment portion 18 of the case body 3 so as to form a tubular opening 106 enabling the cables to be inserted into the case, as shown in FIGS. 9 and 10.

Figure 11:
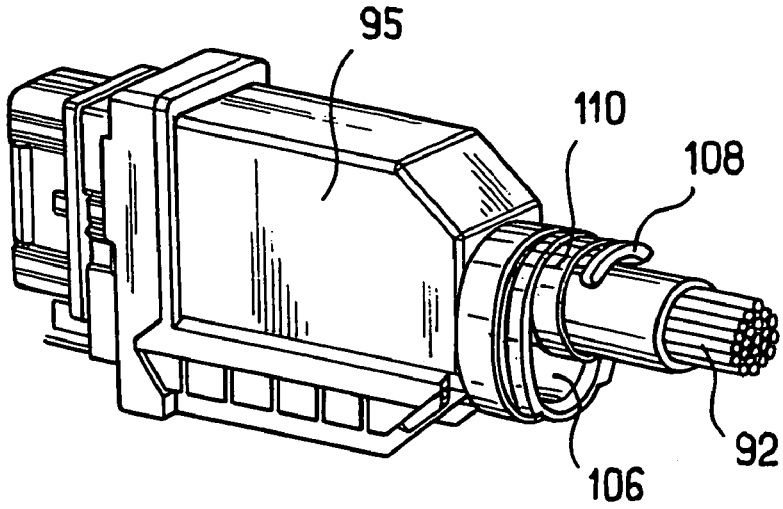
FIGS. 11 and 12 are diagrammatic and fragmentary views of connectors constituting other embodiments of the invention.

The shielding cap 95 further includes a fastening lug 108 projecting outwards from the tubular opening 106 and configured to enable the cables leaving through the opening 106 to be attached thereto, as shown in FIG. 11.

The bundle of cables 92 can be secured to the fastening lug 108, e.g. by means of a clamping collar 110 made of a conductive material, said collar 110 being put into place on the fastening lug 108.

As can be observed, depending on the intended utilization, it is possible to use the shielding cap 95 or to omit it.

The invention thus provides modularity that is satisfactory for the utilization of the various elements of the connector.

Figure 12:
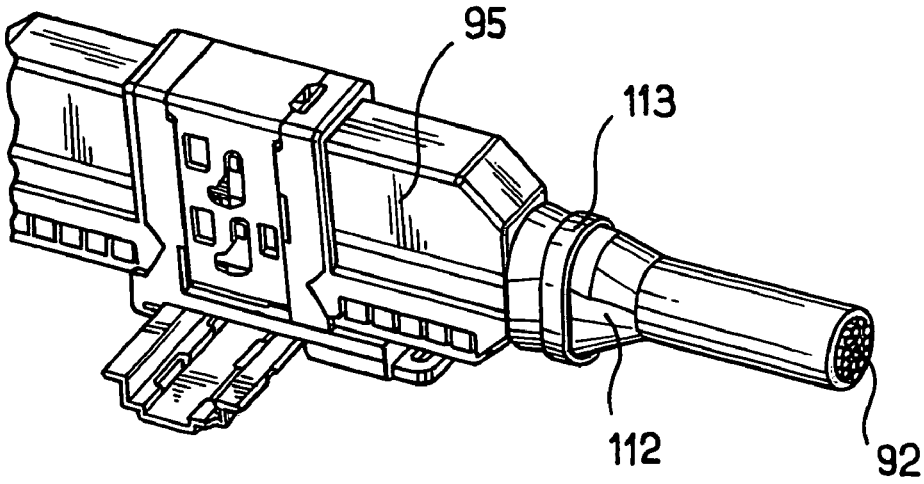

As shown in FIG. 12, the cables 92 may be inserted in a sheath with a ground braid 112 secured to the cable attachment portion of the case body and to the rear portion of the shielding cap 95.

For example, this ground braid 112 is held by means of a clamping piece 113 fitted to said braid 112.

Naturally, the invention is not restricted to the embodiments described above.

For example, one of the heights $h_1$ and $h_2$ may be zero, in which case the two locking zones 21 of the case body 3 may be adjacent to each other, for example.

What is claimed is:

1. A multi-contact connector case configured to be mounted on a support, the case comprising:

a case body including at least one fastener portion configured to co-operate with the support when the case is mounted on the support;

at least one bolt element movable relative to the case body between an unlocked position and a locked position in which the bolt element presses against the support when the case is mounted on the support, the bolt element moving closer to said fastener portion of the case body on passing from the unlocked position toward the locked position; and at least one resilient return member configured to move the bolt element from the unlocked position toward the locked position, the bolt element comprising at least one elastically deformable tab configured to press against a first abutment of the case body when the bolt element is in the unlocked position.

2. A case according to claim 1, wherein the bolt element is mounted slidably on the case body.

3. A case according to claim 1, wherein the case body and the bolt element comprise a housing that receives the resilient return member.

4. A case according to claim 1, wherein the case body comprises a second abutment against which the elastically deformable tab is configured to bear to limit a stroke of the bolt element when the bolt element is moved beyond the locking position.

5. A case according to claim 1, wherein the bolt element comprises a button connected to the elastically deformable tab, the button defining a bearing surface configured to enable a user to exert a force on the elastically deformable tab to unlock the bolt element.

6. A case according to claim 5, wherein the case body comprises a slot through which the button extends.

7. A case according to claim 1, wherein the bolt element comprises a groove that is perpendicular to a sliding direction of the bolt element and configured to co-operate with the support when the bolt element is in the locked position.

8. A case according to claim 1, wherein the case body and the bolt element comprise respective first and second identification surfaces configured in such a manner that when the bolt element is in the unlocked position, the first and second identification surfaces are in a first relative position, and when the bolt element is in the locked position, the first and second identification surfaces are in a second relative position.

9. A case according to claim 1, wherein the bolt element comprises an actuation portion that is configured to provide a hold that allows a user to move the bolt element toward the unlocked position against a force exerted by the resilient return member.

10. A case according to claim 1, wherein the bolt element is made as a single piece.

11. A case according to claim 1, wherein the resilient return member comprises a spring.

12. A case according to claim 1, wherein the fastener portion of the case body comprises at least one tab configured to press against the support when the case is mounted on the support.

13. A case according to claim 1, wherein the case body is electrically conductive.

14. A case according to claim 1, wherein the case body comprises at least one housing configured to receive at least one insulating block for mounting electrical contact elements.

15. A case according to claim 1, wherein the connector is configured to be removably mounted on the support.

16. A case according to claim 5, wherein the bearing surface is configured to enable a user to exert a force on the elastically deformable tab by a finger to unlock the bolt element.

17. A case according to claim 8, wherein the first and second identification surfaces are planar.

18. A case according to claim 8, wherein the identification surfaces are substantially in alignment in the second relative position.

19. A case according to claim 9, wherein the actuation portion includes a slot.

20. A case according to claim 9, wherein the actuation portion is configured to provide a hold configured to be engaged by a tool to move the bolt element.

21. A case according to claim 1, wherein the bolt element is made of plastics material.

22. A case according to claim 11, wherein the spring comprises a helical spring.

23. A case according to claim 12, wherein the tab comprises a deformable tab.

24. A multi-contact connector including the connector case according to claim 1, together with electrical contact elements mounted in the connector case.

25. An assembly comprising:

a support configured to receive at least one multi-contact connector case, the support including two substantially rectilinear and parallel edges, the support comprising at least one indexing notch in at least one of the two edges, the at least one multi-contact connector case configured to be mounted on the support, the case comprising:

a case body including at least one fastener portion configured to co-operate with the support when the case is mounted on the support;

at least one bolt element movable relative to the case body between an unlocked position and a locked position in which the bolt element presses against the support when the case is mounted on the support, the bolt element moving closer to said fastener portion of the case body on passing from the unlocked position toward the locked position; and at least one resilient return member configured to move the bolt element from the unlocked position toward the locked position, the bolt element comprising at least one elastically deformable tab configured to press against a first abutment of the case body when the bolt element is in the unlocked position, wherein the connector case is mounted on the support.

26. A method of mounting the connector case according to claim 1 on a support, the method comprising:

placing the connector case on the support, the bolt element being in the unlocked position; and then actuating the bolt element so as to bring the bolt element into the locked position on the support.

27. A method of removing the connector case according to claim 1 from a support on which the connector case is mounted, the bolt element being initially in the locked position, the method comprising:

moving the bolt element toward the unlocked position; and separating the connector case from the support.

* * * * *